United States Patent [19]

Watts

[11] Patent Number: 4,720,877

[45] Date of Patent: Jan. 26, 1988

[54] DRAIN CLOSURE

[76] Inventor: Robert R. Watts, Rte. 2, Box 153, Blue Springs, Mo. 64015

[21] Appl. No.: 816,701

[22] Filed: Jan. 7, 1986

Related U.S. Application Data

[63] Continuation of Ser. No. 572,741, Jan. 23, 1984, abandoned.

[51] Int. Cl.[4] ..... A47K 1/14; E03C 1/26

[52] U.S. Cl. ..... 4/286

[58] Field of Search ..... 4/286–288, 4/204, 295

[56] References Cited

U.S. PATENT DOCUMENTS

| | | | |
|---|---|---|---|
| 1,760,659 | 5/1930 | Pasman | 4/287 |
| 3,366,980 | 2/1968 | Petursson et al. | 4/295 |
| 3,428,295 | 2/1969 | Downey et al. | 4/295 X |
| 4,369,531 | 1/1983 | Swanson | 4/286 X |

*Primary Examiner*—Charles E. Phillips

*Attorney, Agent, or Firm*—Kokjer, Kircher, Bradley, Wharton, Bowman & Johnson

[57] ABSTRACT

A drain closure that has all of the advantages of and none of the disadvantages of both hand and foot tub closures. A post which is threaded into the bottom of the strainer body receives a stopper which moves up and down on the post to open or close the drain. A metal spring carried by the post exerts a frictional force against the stopper interior sufficient to hold the stopper open and enhance its sealing ability when closed. The stopper can be closed by hand or foot. The stopper cannot be removed without first removing the stopper knob. Out of sight under the stopper is an integral collar which receives an open end wrench which permits tightening of the stopper knob to a point where stopper theft is virtually eliminated.

10 Claims, 7 Drawing Figures

DRAIN CLOSURE

This is a continuation of application Ser. No. 572,741, filed Jan. 23, 1984, now abandoned.

BACKGROUND OF THE INVENTION

This invention relates to drain closures which serve primarily to open and close the drains of bathtubs but which can also be used in sinks, laundry tubs and the like.

Bathtub drain closures are of two basic types; i.e., trip lever and non trip lever. The trip lever device consists of a closure connected by means of a linkage system to a trip lever handle mounted on the front end wall of the tub. The closure is opened and closed by raising or lowering the trip lever handle. The non trip lever closure requires direct contact with hand or foot to open and close.

The main purpose of the present invention is to combine into one closure the advantages of nontrip lever hand and foot operated closures while at the same time eliminating the disadvantages. Another purpose is to provide a stopper which is interchangeable with other stoppers in foot operated closures.

Foot operated closures are opened and closed by pressing down with a foot on the stopper portion of the closure, as described in U.S. Pat. Nos. 3,771,177 and 4,103,372. The principal advantage claimed over hand operated closures is that the user does not have to bend over to operate the closure.

In reality, it is only the ability to close the closure without bending over that is a meaningful advantage. The reason is that, with rare exceptions, the closure is closed only when the user takes a bath which is invariably done in a sitting position. After completing the bath, it is as easy to first open the closure by hand and then stand up and vacate the tub as it is to first stand up, open the closure by foot and then vacate the tub. Therefore, the ability to open a tub closure by foot is of minimal value to most users.

The foot operated closures that are now available have several significant shortcomings. The first is that, due to the necessarily more complicated design, they are less reliable and fail more often than hand operated closures.

Another disadvantage of some foot operated closures is that the closure is susceptible to damage by guests in hotels and motels. Specifically, foot pressure on one side of the stopper is required to open the closure while foot pressure on the opposite side is required to close. Adding to the problem is the fact that the location of these two pressure points will vary from tub to tub depending upon how tightly the stopper assembly is threaded into the tub strainer body. Although the open and close pressure points are marked on the stopper top, these markings are not legible to most while standing up due to poor lighting in the tub bottom and go unnoticed by others. As a result, some guests not familiar with this type of closure, will step down several times without results, becoming convinced that the closure is stuck, and then step down with excessive force or give the stopper a kick to free it up. Damage to the closure can and does occur along with an occasional bruised foot.

A third disadvantage is the ease with which the stopper assembly can be removed and stolen. The stopper assembly is typically installed by threading the post portion of the stopper assembly into female threads located in the bottom of the strainer body. This is accomplished by hand. Further tightening by a pair of pliers or a wrench is normally not done since the application of pressure on the plastic stopper by pliers or a wrench can cause it to crack or flex enough to break the bond between the plastic and the chrome finish. Therefore, it is relatively easy for most people to remove the hand tightened stopper assembly. Unfortunately, some guests in hotels and motels do just that, as do vandals roaming through unfinished housing projects.

As a direct result of this security problem, one manufacturer of foot operated closures has offered a theft resistant model. However, this design has three distinct disadvantages: (1) it costs substantially more; (2) the theft resistant stopper requires a special strainer body and will not fit any other strainer body; and (3) a special tool, available only from this manufacturer, is required to remove the stopper.

Hand operated tub closures are most often a type commonly referred to as lift and turn or lift and lock. In this type of unit, the metal stopper stays in the down position due to its own weight. To open, the stopper is lifted up and then turned in either direction. This rotation positions a small pin over a shoulder on either a post or sleeve and thereby holds the stopper up in the open position.

Lift and turn closures have advantages over foot operated closures in several important respects. The lift and turn closures are much simpler, require fewer moving parts, and are not plagued by field problems to the extend that foot operated closures are. In addition, the lift and turn closures can be made entirely from metal (except for the neoprene seal used by some), as preferred by many plumbers.

The disadvantages of lift and turn closures vary with individual designs. By far the most popular is one which incorporates a metal post that moves up and down inside a sleeve attached to the bottom of the strainer body. The bottom of the post has a retainer ring which prevents the post from being pulled completely out of the sleeve. A small peg or pin protrudes from the post. This peg fits in a slot in the upper portion of the sleeve and prevents the post from turning when in the down or closed position, thereby permitting the stopper to be threaded onto the top end of the post. When the stopper is lifted and rotated, the peg is positioned over the top of the sleeve and holds the stopper in the open position.

One disadvantage of this type of closure is that the stopper can be easily stolen. Only moderate pressure with a tool can be used to tighten the stopper onto the post to avoid breaking the peg. Accordingly, the stopper can be removed relatively easily from the post by thieves and vandals. Another disadvantage is that the peg can be broken if a sharp blow is applied to the top of the stopper while it is in the up or open position.

Another lift and turn design features a post with a flat on one side attached to the bottom of the strainer body. A brass set screw located out of sight is threaded through an integral collar on the bottom of the stopper. The end of the set screw projects beneath a head on top of the post and thereby holds the stopper on the post. When the set screw is aligned with the flat on the post, the stopper drops to the closed position. However, when the stopper is lifted and turned to move the set screw out of alignment with the flat, the set screw rests on a shoulder to hold the stopper up in the open position. Although the problem of stopper theft is virtually eliminated in this type of unit, several other problems are created. A blow applied to the stopper while in the up (open) position can bend the end of the set screw, thus making it impossible to back the set screw off to permit removal of the stopper when it is necessary to obtain access to the drain. Corrosion of the threads on the set screw or collar caused by prolonged exposure to moisture can likewise make it difficult to back off the set screw. Even if the set screw is not damaged or corroded, its out of sight location makes it necessary to locate its head by feel, i.e., by applying the finger to the bottom of the stopper until the head of the set screw is located. This is difficult at best and may be impossible for persons with large fingers. Also, the type (phillips or regular) and size of screw driver to use for loosening of the set screw is not known to persons unfamiliar with this particular closure.

Another lift and turn closure features a plastic skirt attached to the bottom of the stopper. The exterior of the skirt has vertical and horizontal grooves which receive two bosses punched into opposite sides of the top vertical wall of the strainer body. Stopper theft can be easily accomplished simply by pulling up on the stopper and continuing to rotate it. Another disadvantage is that a sharp blow to the stopper top can cause damage to the plastic skirt or cause the bosses and grooves to disengage and thereby jam the closure.

All lift and turn closures have one common disadvantage compared to foot operated closures—they cannot be closed without bending over and operating the closure by hand.

Still another non trip lever closure is best described referred to as a push-pull. It operates the same as a lift and turn closure except that no rotation of the stopper is required in order to keep the stopper open in the up position. The push-pull stopper features one or more rigid plastic legs that are deflected to install the stopper. The main disadvantage of this design is that a sharp pull upward is all that is required to remove the stopper. Another disadvantage is that the plastic legs are relatively fragile as compared to metal and are susceptible to fracture. A plastic construction is necessary because of the need for the legs to deflect. As a result, this design is generally unacceptable.

SUMMARY OF THE INVENTION

The proliferation of designs in hand and foot operated tub closures is a direct result of attempts by various manufacturers to solve the problems that have plagued non trip lever closures for many years. Unfortunately, these designs have created almost as many problems as they have solved. In addition, many plumbing wholesalers are now forced to stock several different types of non trip lever closures to meet the varying preferences of their customers. The present invention provides an improved closure with all of the meaningful advantages and none of the meaningful disadvantages of both hand and foot operated closures.

In accordance with the invention, the stopper is mounted to slide up and down on a special post threaded into the bottom of the strainer body. The post is equipped with a spring which expands against the internal surface of the stopper to provide a frictional force sufficient to hold the stopper in place. When the stopper is pulled upwardly to the open position, it is held open by the frictional force. The stopper can be closed by pushing down on any portion of it. It is noteworthy that either foot or hand pressure can be applied to any part of the stopper at virtually any angle. The spring also helps to maintain the stopper in the closed position and thereby effects a more reliable seal between the stopper and strainer body. In a preferred form of the invention, the spring takes the form of an interrupted ring which fits in a groove in the post and which tends to radially expand against the stopper to apply the necessary frictional force. Alternatively, a ball element loaded by a compression spring can be used if desired.

A knob is threaded into the top of the stopper to enclose the enlarged head of the post. Further inhibiting stopper theft is the fact that the knob and stopper appear to be a single integral part.

The manner in which the drain closure is constructed and assembled essentially eliminates the problem of stopper theft. At the same time, the stopper can be easily closed by hand or foot and can easily be opened by hand while the user is sitting in the bathtub. The unit is considerably less complex than currently available foot actuated closures, and it can be manufactured entirely from metal to meet the requirements of many plumbers. There is no cycling of springs or other parts that can lead to fatigue or wear problems, and even repeated severe blows to the stopper do not cause significant damage. In addition, a more effective seal is provided in the closed position due to the frictional force applied by the spring.

DETAILED DESCRIPTION OF THE INVENTION

In the accompanying drawings which form a part of the specification and are to be read in conjunction therewith and in which like reference numerals are used to indicate like parts in the various views.

Figure 1:
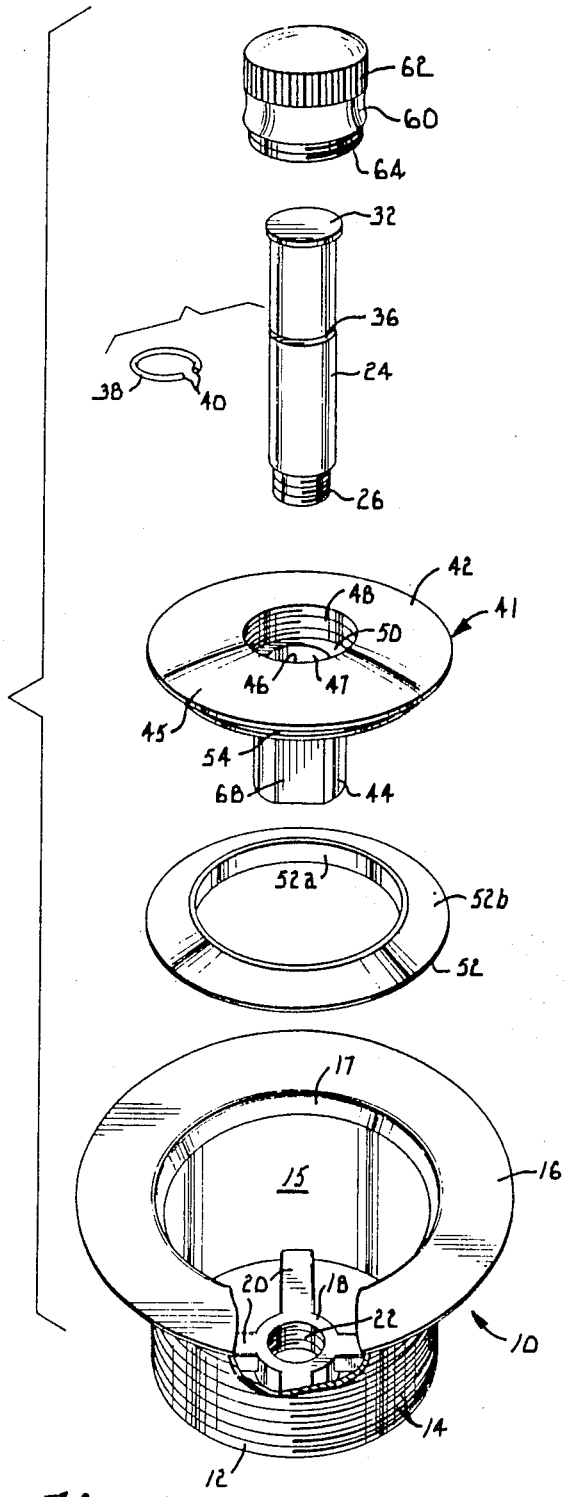
FIG. 1 is an exploded perspective view of a bathtub drain closure constructed according to a preferred embodiment of the present invention, with a portion of the strainer body broken away for purposes of illustration.

Referring now to the drawing in detail and initially to FIGS. 1–4, numeral 10 generally designates a strainer body having a cylindrical wall 12 which is externally threaded at 14 in order to thread into a drain fitting under the floor of a bathtub (or a sink, laundry tub or other drain opening). Within the strainer body, a drain passage 15 is provided for draining of liquid from the tub. The top edge of the strainer body 10 is provided with an annular flange 16. The top or entry to passage 15 is tapered or beveled as indicated by numeral 17, although it need not be. Formed within the lower portion of the strainer body is a ring 18 carried on a spider 20 secured to the inside surface of the wall 12. The ring 18 is concentric with wall 12 and has internal threads 22.

Mounted within the strainer body 10 is a brass post 24 having male threads 26 on its bottom end that mate with the female threads 22 of ring 18. The post 24 can thus be threaded into ring 18 and is mounted in this manner to extend along the central axis of the strainer body. The main body or shank of post 24 is cylindrical. A flat head 32 is formed on the upper end of post 24. The head 32 is enlarged in diameter compared to the shank of post 24.

An annular groove 36 is formed in the shank of post 28 at a location somewhat above its midpoint. An arcuate metal spring element 38 is inserted into groove 36 and fits closely therein. The spring element 38 has the shape of a discontinued or interupted ring with two free ends 40 spaced apart and confronting one another. The ends 40 are preferably rounded so that no sharp corners are presented.

Fitted on post 24 is a metal stopper 41 having a disk shaped head 42 and an integral sleeve 44 projecting from its lower surface. The head 42 has an enlarged flange 45 forming its top surface. A cylindrical bore 46 is formed centrally through the stopper 41. The bore is surrounded by an internal surface 47 of the stopper. The upper portion of the bore 46 within head 42 larger than the remainder of the bore and is internally threaded at 48. An upwardly facing annular shoulder 50 is formed within the bore at the lower end of the threaded portion 48 where it intersects with the main bore surface 47.

The stopper head 42 is larger in diameter than the drain passage 15 provided within the strainer body 10. A flapper type gasket 52 includes a ring portion **52*a* which fits closely in an annular groove 54 formed in the outer edge of the stopper head at a location immediately below the flange 45. The gasket 52 also includes a rim portion 52*b* which projects generally outwardly from the rim 52*a*. In this natural undeformed condition, the rim 52*b* has a frusto-conical shape. When the stopper 41 is in the fully closed position shown in FIG. 2, the rim 52*b* is pressed flat against the strainer body flange 16 by the stopper flange 45 to form a tight seal which closes the drain passage 15. In the open position of the stopper shown in FIG. 3**, the stopper head and flapper are displaced well above the top of the strainer body, and the drain is then opened for drainage of liquid from the bathtub or other vessel equipped with the drain closure.

It should be understood that the flapper 52 is optional and is not necessary for a satisfactory seal, although it does provide some added protection against leakage. The stopper may instead be equipped with an O-ring or another type of sealing element, or it may be constructed to seal the drain passage without any separate sealing element at all. The closure of the present invention does not depend upon any particular seal to work effectively.

Figure 2:
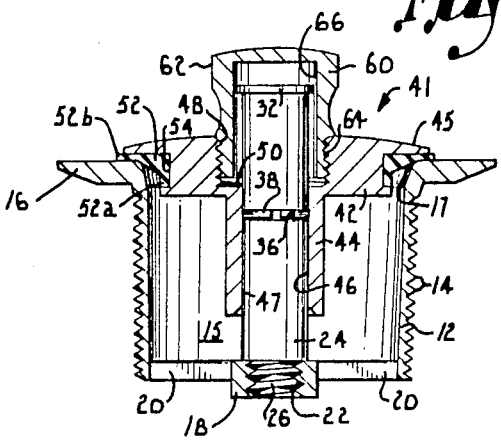
FIG. 2 is a sectional view of the assembled drain closure taken on a vertical plane and showing the stopper in the closed position.

The bore 46 has a slightly larger diameter than the post 24, and the stopper 41 is received on post 24 for up and down sliding movement thereon between the open position (FIG. 3) and the closed position (FIG. 2). At the same time, the close fit of bore 46 on post 24 prevents the stopper assembly from wobbling. In addition, the fit of post 24 in bore 46 permits the stopper 41 to turn about the axis of the vertical post 24. When stopper 41 is fitted on post 24, the internal stopper surface 47 compresses spring 38 into groove 36. The internal spring force of the compressed spring 38 causes the spring to expand radially against surface 47 at all positions of the stopper, thereby exerting a spring force between the post and stopper.

In assembling the closure, the stopper 41 is applied to the bottom end of post 24, and the enlarged head 32 of the post is able to enter the threaded area 48 but not the smaller main portion of bore 46. The head 32 contacts shoulder 50 to prevent the stopper from being lifted off the top of the post 24 or moving upwardly on the post beyond the position shown in FIG. 3.

The upper end of bore 46 is closed by a knob 60 having a knurled exterior surface 62. The lower end of the knob is externally threaded at 64 in order to mate with the internal threads 48 formed in the upper portion of bore 46. When the knob 60 is threaded into the stopper head 42, it closes the top end of bore 46 and encloses the head 32 of the post. Extending upwardly into knob 60 is an internal blind passage 66 having a slightly larger diameter than the post head 32. The head 32 of post 24 is accommodated within passage 66, as best shown in FIG. 2. Knob 60 facilitates lifting of the stopper and inhibits stopper theft, as will be explained more fully.

Figure 3:
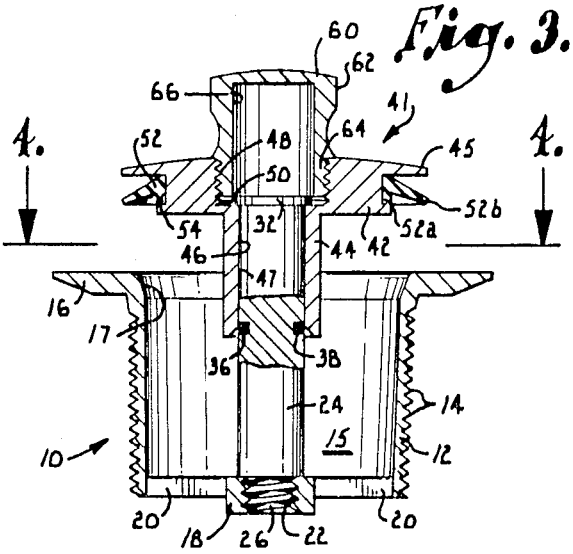
FIG. 3 is a sectional view similar to FIG. 2, but showing the stopper raised to the open position.
Figure 4:
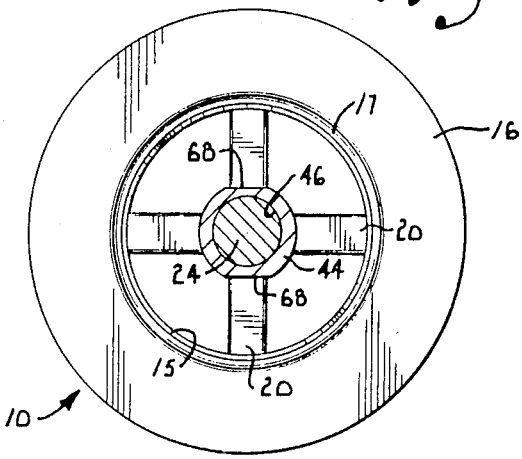
FIG. 4 is a sectional view taken generally along line 4—4 of FIG. 3 in the direction of the arrows.

With particularly reference to FIGS. 1 and 4, the sleeve 44 is provided with flat opposite sides 68 for receiving a standard 9/16 inch open end wrench. As best shown in FIG. 3, the sleeve 44 and its flat sides 68 are exposed sufficiently to receive a wrench only when the stopper is in the fully open position. By applying a wrench to the flat sides 68, the stopper assembly can be held in place while knob 60 is threaded tightly into the stopper by applying pliers or another tool to the knurled portion 62 of the knob. When the knob has been fully tightened on the stopper, it appears to be an integral part of the stopper rather than a separate part as it actually is.

The drain closure is installed by first applying the stopper 41 to the post 24 and then threading the lower end 26 of the post into ring 18 of the strainer body. The knob 60 is then threaded onto the top of the stopper to complete the installation. Once installed, the stopper 41 cannot be removed from post 24 until the knob 60 h as first been removed and post 24 has been disconnected from the strainer body 10.

Normal installation calls for the installer to grasp the stopper 41 in one hand, thread on the knob 60 with the other hand, and then further tighten the knob with pliers or a wrench. For additional protection against stopper theft, the installer may apply a standard 9/16 inch open end wrench to the flat sides 68 of sleeve 44 in order to hold the stopper while the knob 60 is further tightened with pliers or a wrench.

Assuming that normal installation has occured, the possibility of stopper theft is very remote since most stopper thefts are spur of the moment and are accomplished without the use of any tools. Very few people have a strong enough grip to unscrew the knob 60 which is necessary for stopper removal. In addition, the knob 60 and the stopper 41 appear to be a single integral piece, similar to most lift and turn stoppers now on the market. This alone deters some stopper thefts. In order to remove post 24, it must be threaded out of the ring 22, and the post is not accessible for turning. The stopper 41 turns on the post to frustrate any attempt to unscrew the post by turning the stopper.

In use of the drain closure, the stopper 41 can be moved to the closed position of FIG. 2 simply by pressing downwardly with hand or foot on the stopper or knob 60. The stopper then slides downwardly until the flapper 52 is flattened and seals tightly against the flange 16 of the strainer body. In addition to the weight of the stopper assembly, the friction provided by the spring 38 helps to retain the stopper in the closed position, thereby enhancing its effectiveness in preventing leakage.

It is noted that the foot or hand pressure can be applied to any portion of the stopper assembly at virtually any angle and without the need for undue force. The only force that needs to be overcome to move the stopper assembly downwardly is the frictional force provided by the spring 38 bearing against the internal surface 47 around bore 46.

To open the drain closure, knob 60 is grasped and pulled upwardly to raise the stopper assembly to the open position of FIG. 3. This is easily done since the user will be sitting in the bathtub at the time it is to be drained. When the stopper assembly has been raised to the fully open position, it can be released, and the frictional force provided by the spring 38 expanding acting against surface 47 thereafter retains the stopper in the open position. The compressed spring 38 expands outwardly with sufficient force to provide a frictional force between the spring and stopper that is greater than the weight of the stopper assembly. Accordingly, the weight of the stopper is insufficient to lower it from the open position, and it is maintained in the open position until again moved by hand or foot to the closed position. The frictional force is the sole force holding the stopper open, and it can be overcome by pushing downwardly with the hand or foot.

It is pointed out that the spring 38 is maintained at all times under virtually the same amount of compression and is not stretched and compressed each time the unit is cycled between the open and closed positions. Consequently, the spring is not subject to fatigue or other failure due to cycling, and it can continue to maintain the same force against surface 47 virtually indefinitely. It is also noted that the ability of the stopper assembly to rotate on post 24, along with the rounded configuration of the spring ends 40, minimizes the wear on the stopper surface 47 and avoids the formation of grooves therein.

It is thus apparent that the unique drain closure of this invention takes full advantage of the desirable features of both foot and hand actuated closures without any of the disadvantages of either type of unit. The construction is simple and reliable in comparison to foot actuated devices, and yet it takes full advantage of the main desirable feature of the foot actuated device, namely the ability to effect closure with the foot without the necessity of bending down. Also, the closure can be constructed entirely from metal (except for the flapper 52 if it is provided), as preferred by most plumbers and required by many. There is no tendency for the stopper assembly to stick or jam, and it is able to withstand repeated blows without being damaged. Forces that are applied to the stopper while it is in the closed position are spread throughout the assembly and are not concentrated at any one area or on any one part.

The entire closure unit, including the strainer body 10, can be installed on both new and existing bathtubs and on other vessels such as sinks, laundry tubs and similar containers which must be drained. It is important to note that the stopper 41 and post 24 can be installed in anexisting strainer body in place of the foot operated stopper that was originally in the strainer body. It is contemplated that the post and stopper will be provided in replacement kit form without the strainer body for installation in existing strainer bodies to replace foot operated stoppers.

Figure 5:
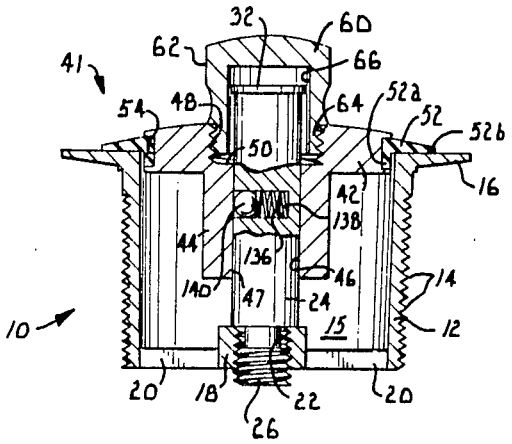
FIG. 5 is a sectional view similar to FIG. 2 but showing a second embodiment of the invention, with the stopper in the closed position.
Figure 6:
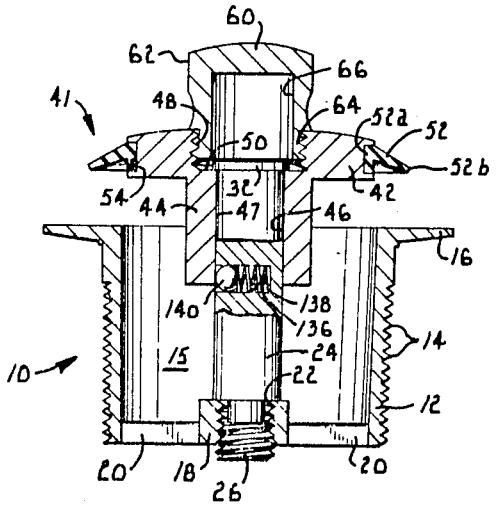
FIG. 6 is a sectional view similar to FIG. 5, but with the stopper in the open position.
Figure 7:
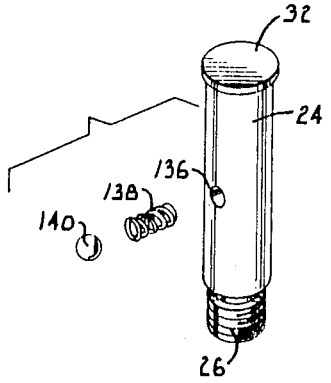
FIG. 7 is an exploded perspective view of the post and the spring loaded ball element included in the second embodiment of the invention.

FIGS. 5–7 illustrate an alternative embodiment of the invention which for the most part is identical to the embodiment shown in FIGS. 1–4, as indicated by the use of the same reference numerals for identical parts. The only significant difference in the embodiment shown in FIGS. 5–7, is that the groove 36 and spring 38 are eliminated and replaced by a lateral blind passage 136 in post 24 and a coiled compression spring 138 which acts against a metal ball 140. The passage 136 extends generally radially into shank 28 and receives the spring 138. The spring engages the base or blind end of passage 136 at one end and the ball 140 at the other end. The ball is urged outwardly by spring 138 and projects slightly out of passage 136 so that it can engage and apply a friction force against the internal surface 147 of stopper 141. The beveled surface 17 shown in FIGS. 1–4 may be eliminated in the strainer body shown in FIGS. 5 and 6, as may the enlarged flange 45 on the stopper head.

The form of the invention shown in FIGS. 5–7 differs from that of FIGS. 1–4 only in the specific arrangement of the spring action between the post and stopper. As shown in FIG. 5, when the stopper is pushed downwardly to the closed position, the gasket rim **52*b* seats firmly on top of the flange 16 of the strainer body in order to provide a seal between the gasket and strainer body for effective closing of the drain. The use of the flapper 52 permits the stopper to be used with strainer bodies whether or not they include the beveled surface 17**.

When the stopper 41 has been raised to the fully open position of FIG. 6 and released, the frictional force exerted by ball 140 against surface 47 retains the stopper in its open position in much the same manner as spring 38. The compression spring 138 pushes outwardly on ball 140 with enough force to provide a frictional force between the ball and stopper that is greater than the weight of the stopper assembly. Like spring 38, spring 138 is maintained under virtually the same compression at all times and is not cycled such that it would be subject to fatigue. Also, the ability of post 26 to rotate results in even wear and avoids the formation of ruts in the surface 47.

Like the stopper assembly of FIGS. 1–4, the stopper assembly shown in FIGS. 5 and 6 can be provided along with the strainer body 10 or it can be provided alone to replace a previously installed stopper assembly such as that of a conventional foot operated closure. In order to carry out the replacement, the existing stopper assembly is removed from the strainer body, and the new stopper is installed in the strainer body in place of the old stopper assembly. Installation is carried out in the same manner set forth in connection with FIGS. 1–4, and the stopper assembly functions in essentially the same manner described previously in connection with FIGS. 1–4.

I have found the spring 38 to be preferable from a manufacturing and assembly standpoint, and it is thus preferred in most instances, although the spring and ball arrangement shown in FIGS. 5–7 also works in a satisfactory manner.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having this described the invention, I claim:

1. A drain closure for controlling a drain having a strainer body, said drain closure comprising:

a post adapted to be mounted to the strainer body, said post having an annular groove therein;

a stopper mounted on said post for sliding movement thereon between open and closed positions, said stopper having a bore in which said groove is enclosed at all positions of said stopper between the open and closed positions;

seal means on said stopper adapted to seal against the strainer body in the closed position of said stopper and to release from the strainer body in the open position of said stopper; and a curved spring element formed by an interrupted metal ring fitted in said groove in a compressed state and expanding outwardly against said stopper within said bore thereof by spring action to exert a spring force on the stopper which maintains said stopper in the open position when the stopper is moved thereto, said spring element providing the sole force acting to hold said stopper in the open position and being overcome by a predetermined force applied to said stopper in a direction to move same toward the closed position.

2. A drain closure as set forth in claim 1, including an internal surface of said stopper surrounding said bore, said post being received in said bore in a manner permitting said stopper to slide on the post between the open and closed positions.

3. A drain closure as set forth in claim 2, including:

a threaded top end portion of said bore larger than the remainder of the bore;

an enlarged head on said post small enough to fit in said top end portion thereof but too large to pass through the remainder of the bore, said head being accessible to be released from the stopper when said top end portion of the bore is exposed; and a threaded knob mating with said top end portion of the bore to close the same and facilitate lifting of said stopper to the open position.

4. A drain closure as set forth in claim including:

a sleeve portion of said stopper accessible to receive a wrench in the open position of the stopper; and a pair of flat surfaces on said sleeve portion adapted to receive a wrench to facilitate tightening of said knob on said stopper.

5. A drain closure comprising:

a strainer body adapted to be installed in a drain;

a post mounted to said strainer body and extending therein, said post including a shank having a preselected uniform diameter and said post being mounted in the strainer body in a manner to retain the post against axial movement therein;

a stopper on said post mounted thereon for up and down movement between open and closed positions of the stopper, said stopper presenting a bore therein having a substantially uniform diameter to closely receive said shank and said bore being bounded by a surface of the stopper which closely surrounds said shank;

seal means on said stopper for sealing against said stainer body in the closed position of the stopper to close the drain, said seal means being unsealed from said strainer body in the open position of said stopper to open the drain;

a friction member on said shank of the post contacting said stopper surface and applying a frictional force thereto for holding the stopper in the open position thereof; and spring means for urging said friction member against said stopper surface to apply a substantially constant frictional force thereto sufficient to overcome the weight of said stopper, whereby the stopper is held in the open position when moved thereto and can be moved between the open and closed positions by applying sufficient force to overcome the frictional force, said uniform diameter of the bore preventing said spring means from expanding and contracting as the stopper is moved between the open and closed positions.

6. A drain closure as set forth in claim 5, including:

a groove in said shank of the post in which said friction member is received, said friction member having the shape of an interrupted ring which is compressed in said groove and which resists such compression by spring action to provide said spring means.

7. A drain closure as set forth in claim 6 including an enlarged head on said post having a size to prevent said stopper from being lifted off of the post.

8. A drain closure as set forth in claim 7, including:

an open top end of said bore providing access to said head when said top end of the bore is exposed; and a removable knob for said stopper fitting thereon in a manner to close said top end of the bore, thereby enclosing said head.

9. A drain closure as set forth in claim 8, including:

a threaded connection between said knob and stopper;

a sleeve portion of said stopper extending wholly within said strainer body in the closed position of the stopper and located partially out of said strainer body in the open position of the stopper; and a tool receiving surface of said sleeve portion accessible to a tool in the open position of said stopper for holding of the stopper to facilitate tightening of said threaded connection between said knob and stopper.

10. A drain closure as set forth in claim 9, including a threaded connection between said post and strainer body requiring turning of the post for removal thereof from the strainer body, said post being inaccessible for turning while said stopper is fitted thereon.

* * * * *